US011702895B2

(12) United States Patent
Sauthoff

(10) Patent No.: US 11,702,895 B2
(45) Date of Patent: Jul. 18, 2023

(54) STATORLESS SHEAR VALVE PULSE GENERATOR

(71) Applicant: Baker Hughes, a GE company, LLC, Houston, TX (US)

(72) Inventor: Bastian Sauthoff, Burgdorf (DE)

(73) Assignee: Baker Hughes Holdings LLC, Houston, TX (US)

( * ) Notice: Subject to any disclaimer, the term of this patent is extended or adjusted under 35 U.S.C. 154(b) by 0 days.

(21) Appl. No.: 16/557,440

(22) Filed: Aug. 30, 2019

(65) Prior Publication Data

US 2020/0072005 A1 Mar. 5, 2020

Related U.S. Application Data

(60) Provisional application No. 62/763,132, filed on Aug. 30, 2018.

(51) Int. Cl.

| | |
|---|---|
| ***E21B 21/08*** | (2006.01) |
| ***E21B 47/06*** | (2012.01) |
| ***E21B 49/00*** | (2006.01) |
| *E21B 47/22* | (2012.01) |
| *E21B 47/12* | (2012.01) |

(52) U.S. Cl.

CPC ..... *E21B 21/08* (2013.01); *E21B 47/06* (2013.01); *E21B 49/003* (2013.01); *E21B 47/124* (2013.01); *E21B 47/22* (2020.05)

(58) Field of Classification Search

CPC ..... E21B 47/12; E21B 21/08; E21B 47/06; E21B 49/003; E21B 47/22; E21B 47/24; E21B 47/18

See application file for complete search history.

(56) References Cited

U.S. PATENT DOCUMENTS

| | | | | |
|---|---|---|---|---|
| 3,958,217 | A | 5/1976 | Spinnler | |
| 4,953,595 | A | 9/1990 | Kotlyar | |
| 5,215,152 | A | 6/1993 | Duckworth | |
| 6,219,301 | B1 | 4/2001 | Moriarty | |
| 6,615,926 | B2 * | 9/2003 | Hester | E21B 43/128 166/106 |
| 6,636,159 | B1 | 10/2003 | Winnacker | |
| 7,808,859 | B2 | 10/2010 | Hahn et al. | |
| 9,316,072 | B2 | 4/2016 | Rogers et al. | |
| 10,378,283 | B2 * | 8/2019 | Peters | E21B 4/02 |

(Continued)

FOREIGN PATENT DOCUMENTS

DE 19939262 C1 11/2000

OTHER PUBLICATIONS

Int'l Search Report and Written Opinion in PCT/US2019/049190, dated Apr. 6, 2020.

*Primary Examiner* — Ryan W Sherwin
(74) *Attorney, Agent, or Firm* — Crowe & Dunlevy, P.C.

(57) ABSTRACT

An apparatus for generating pressure variances in a fluid flowing in a downhole tool having a longitudinal axis includes a flow section having an outer wall, a flow control member selectively blocking flow in the flow section, and an actuator moving the flow control member between a first position wherein the flow control member at least partially blocks flow in the flow section and a second position wherein the flow control member reduces the at least partial blockage of the flow in the flow section. The actuator may be disposed outside the outer wall of the flow section.

20 Claims, 12 Drawing Sheets

(56) References Cited

U.S. PATENT DOCUMENTS

| | | | | |
|---|---|---|---|---|
| 10,544,625 | B2 * | 1/2020 | Strange | E21B 21/08 |
| 2005/0260089 | A1 | 11/2005 | Hahn et al. | |
| 2006/0102346 | A1 | 5/2006 | Casey | |
| 2007/0182583 | A1 * | 8/2007 | Feluch | E21B 47/24<br>340/855.4 |
| 2015/0267534 | A1 * | 9/2015 | Gosney | E21B 7/24<br>175/25 |
| 2016/0312559 | A1 | 10/2016 | Gotlib et al. | |
| 2017/0051610 | A1 | 2/2017 | Sitka et al. | |
| 2017/0058667 | A1 | 3/2017 | Liu et al. | |
| 2017/0089173 | A1 * | 3/2017 | Zhao | E21B 47/06 |
| 2017/0234106 | A1 * | 8/2017 | Mathiesen | G05D 7/01<br>166/53 |
| 2018/0119513 | A1 * | 5/2018 | Vincent | E21B 47/12 |
| 2018/0230800 | A1 * | 8/2018 | Turner | E21B 47/20 |
| 2018/0340383 | A1 * | 11/2018 | Bakker | E21B 21/08 |
| 2019/0120048 | A1 * | 4/2019 | Coffin | E21B 47/06 |
| 2019/0203592 | A1 * | 7/2019 | Odegbami | E21B 47/24 |
| 2020/0248531 | A1 * | 8/2020 | Walton | E21B 33/12 |

* cited by examiner

STATORLESS SHEAR VALVE PULSE GENERATOR

CROSS-REFERENCE TO RELATED APPLICATIONS

This application claims priority from U.S. Provisional Application Ser. No. 62/763,132 filed on Aug. 30, 2018, the entire disclosure of which is incorporated herein by reference in its entirety.

BACKGROUND OF THE DISCLOSURE

1. Field of the Disclosure

The disclosure relates generally to systems and methods for treating subsurface features.

2. Description of the Related Art

Drilling fluid telemetry systems, generally referred to as mud pulse systems, are particularly adapted for telemetry of information from the bottom of a borehole to the surface of the earth during oil well drilling operations. The information telemetered may include, but is not limited to, parameters of pressure, temperature, direction and deviation of the well bore. Other parameters include logging data such as resistivity of the various layers, sonic density, porosity, induction, and pressure gradients. Valves that use a controlled restriction placed in the circulating mud stream are commonly referred to as mud pulse systems, for example see U.S. Pat. No. 3,958,217. Mud pulsing valves close a fluid path (positive pulse) or open the fluid path (negative pulse). Illustrative mud pulsing valves include poppet valves and rotating disk valves. Some of these conventional valve arrangements use relatively small fluid passages, which can become clogged by materials entrained in the circulating fluid. It may be difficult or impossible to unblock a blocked mud pulsing valve due to limited force (power) available with the actuation system of the valve. Depending on the shape of the valve a big angular momentum may be needed to free a blocked valve, depending on the leaver defined by the shape of the valve. Other conventional valve arrangements are relatively slow because these valves must work against differential pressure and do not shear the mud flow.

This disclosure provides, in part, pulse generators that are not susceptible to clogging from such entrained material and can move faster than conventional valves.

SUMMARY OF THE DISCLOSURE

In aspects, the present disclosure provides an apparatus for generating pressure variances in a fluid flowing in a downhole tool having a longitudinal axis. The apparatus may include a flow section directing the fluid flow, the flow section having an outer wall; a flow control member selectively blocking flow in the flow section; and an actuator configured to move the flow control member between a first position wherein the flow control member at least partially blocks flow in the flow section and a second position wherein the flow control member reduces the at least partial blockage of the flow in the flow section. The actuator may be disposed outside the outer wall of the flow section.

In aspects, the present disclosure provides a method for generating pressure variances in a fluid flowing in a downhole tool having a longitudinal axis. The method may include directing the fluid flow in a flow section having an outer wall; selectively blocking flow in the flow section using a flow control member; and moving the flow control member between a closed position and an open position using an actuator. The flow control member may at least partially block flow in the flow section in the closed position and the flow control member may reduce the at least partial blockage of the flow in the flow section in the open position. The actuator may be disposed outside the outer wall of the flow section.

It should be understood that examples of certain features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION

The present disclosure relates to devices and methods for enabling communication via pressure variations in a flowing fluid. Illustrative embodiments of systems and related methods for generating pressure pulses in a fluid circulated in a wellbore are discussed below. Advantageously, the disclosed pulse generating devices (mud pulse system) are less susceptible to clogging and impaired operation if the fluid includes or is replaced with a fluid having entrained solids. If clogging of the drill string occurs during flow of lost circulation material (LCM), the drill string must be removed from the well. This is a costly and complex operation. It is vital, therefore, to maintain the ability to transport LCM downhole via the drill string to arrest lost circulation problems in the well. LCM must, therefore, pass through all elements of the drill string, including the pulse generating device of a downhole tool. While the present disclosure is discussed in the context of a hydrocarbon producing well, it should be understood that the present disclosure may be used in any borehole environment (e.g., a geothermal well, water well).

An apparatus as described herein may be used to generate pulses in a fluid column within a flow line in a downhole well or wellbore to facilitate mud pulse telemetry. This terminology embraces communication through pulses in a fluid column of any kind that may be in a well. An example of such use is for the apparatus to be placed in a drill string together with MWD or LWD tools, to communicate data from the measurement wile drilling or logging while drilling tools (MWD/LWD) upwardly and to the surface through the fluid column that is flowing downwardly through the drill string to exit via the drill bit. The pulses may be detected and decoded at the surface, thereby communicating data from tools or other sensors (pressure, temperature, vibration, magnetometer, resistivity, acoustic, NMR, sampling, nuclear) in the bottom whole assembly (BHA), or elsewhere in the drill string. The described apparatus opens and closes one or more fluid passage in the flow line to create pulses in the fluid column of a selected duration and pattern which are detectable at the surface.

Figure 1:
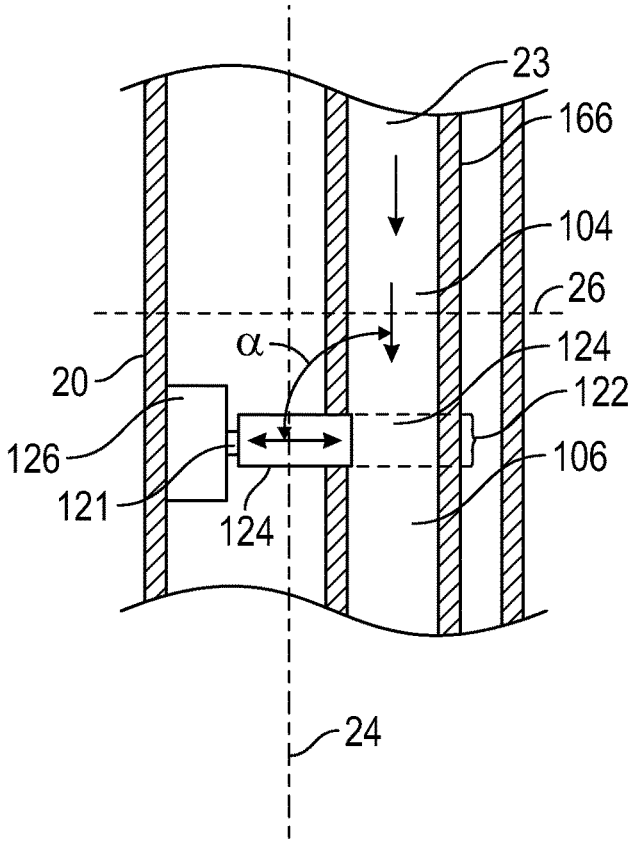
FIG. 1 schematically illustrate a pulse generator in accordance with one embodiment of the present disclosure that uses a translating flow control member.

Referring now to FIG. 1, there is shown a non-limiting arrangement of a pulse generator 100 in accordance with the present disclosure that is positioned in a section of a drill string. The section of the drill string includes a flow line 104 which has a flow control member 124 incorporated. An actuator 126 is driving the flow control member 124. The flow control member 124 depicted in FIG. 1 is a translational valve element (linear movement of the valve element), which reduces the available cross sectional flow area or even completely blocks. FIG. 1 shows the valve element in open position. The closed position is shown in hidden lines. The arrangement in FIG. 1 shows an embodiment in which the movement of the flow control member 124 shears the flow direction of the fluid in perpendicular direction. The angle $\alpha$ between the moving direction of the flow control element 124 and the direction of the fluid flow 23 is 90°. The actuator 126 is housed beside the flow line 104 inside the downhole tool. In the illustrated embodiment, a flow control member 124 is moved by an actuator 126 that is situated outside the fluid or fluid flow. Thus, the actuator 126 including an optional actuator housing, or any compartment in which the actuator 126 may be situated, is outside of the flow line or flow section, and is not in contact with or immersed in the fluid. The actuator 126 is outside the outer limit or outer wall 166 of the flow line. The actuator 126 is not surrounded by fluid or fluid flow. When actuated the flow control member 124 either reduces or increases the effective flow area the fluid has available to pass through the flow line, thereby creating pressure variations, also referred to as pressure pulses or mud pulses. The mud pulse travels within the fluid column inside the flow line to a location where the pressure variation is detected, such as by a pressure sensor at the surface of the wellbore. As downhole tools are having limited diameter (typically between 3 and 12¼ inch in diameter) the space available to host an actuator beside a flow line, which typically is around 1 to 3 inch in diameter (inner bore), is very limited.

Figure 1A:
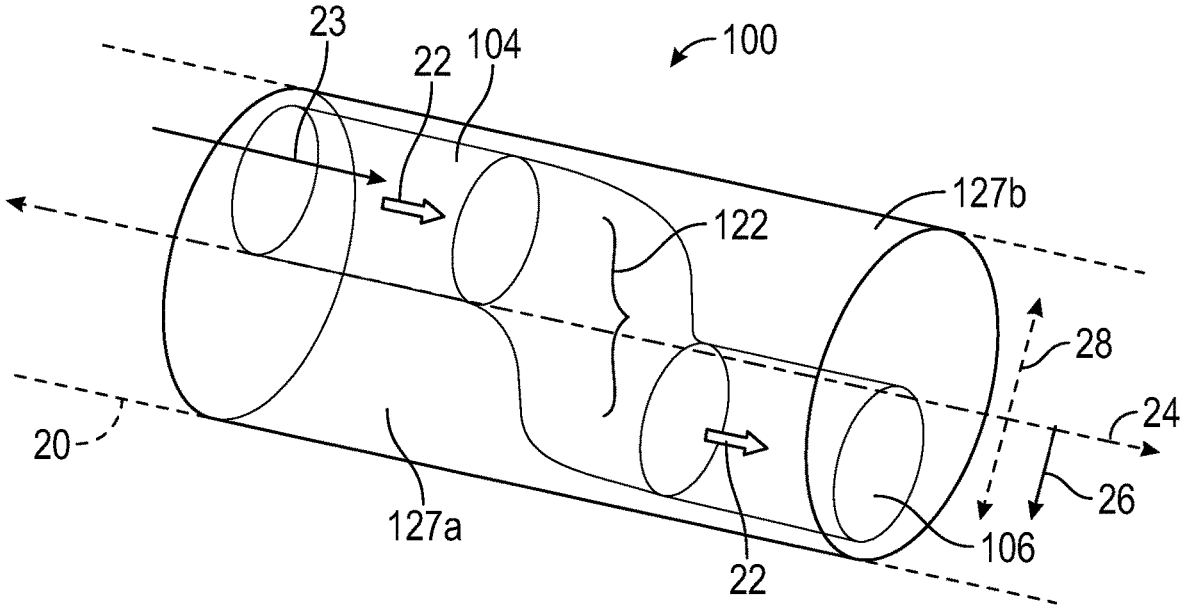
FIG. 1A is an isometric view of a pulse generator in accordance with another embodiment of the present disclosure.

Referring now to FIG. 1A, which shows and alternative embodiment. There is shown an illustrative pulse generator 100 in accordance with the present disclosure that is positioned in a section of a drill string 20, shown in hidden lines. For the purposes of the present disclosure, an axial direction 22 is a direction along a longitudinal axis 24 of the downhole tool or drill string 20. A radial direction 26 is a direction along an axis 28 that is transverse to the longitudinal axis 24. The pulse generator 100 may be inserted between and in fluid communication with a first flow line 104 and a second flow line 106. The first flow line 104 is radially offset from the second flow line 106. As a result, some or all of the fluid flowing along the first flow line 104 must travel in the radial direction 26 for some distance before entering the second flow line 106. This radial direction 26 may have angular variance as discussed later. The first flow line 104 and the second flow line 106 may direct flow in a direction aligned with the longitudinal axis 24 of the drill string section 20. By "aligned," it is meant a parallel orientation.

The pulse generator 100 acts on the fluid flowing from the first flow line 104 to the second flow line 106. In the illustrated embodiment, fluid enters the pulse generator 100 from the flow line 104 and exits the pulse generator 100 via the second flow line 106. However, an opposite flow may also be used. It should be noted that the first and second flow lines 104, 106 may connect with fluid lines that are not radially offset. For instance, a bore in a drill string 16 (FIG. 10) may be centrally positioned and the flow lines 104, 106 may be merely localized re-direction of flow in a radially offset fashion.

Figure 2:
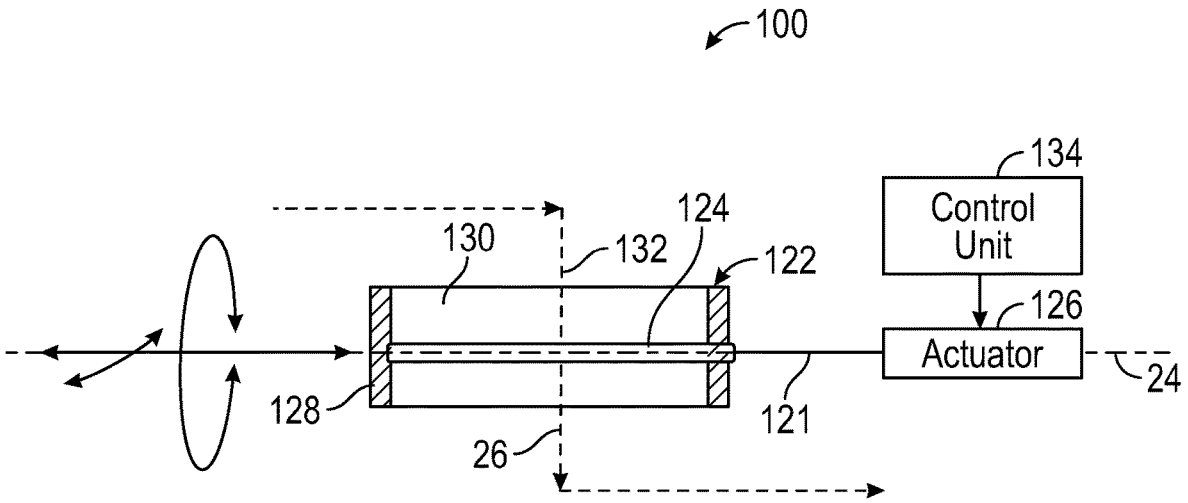
FIG. 2 is a schematic view of the FIG. 1A pulse generator.

Referring to FIG. 2, the pulse generator 100, which is schematically illustrated, may include a flow section 122, a flow control member 124, and an actuator 126. The flow section 122 may include a body 128 in which a fluid passage 130 is formed. The fluid passage 130 may have a circular, oval, elliptical, square, or another other cross-sectional shape. The fluid passage 130 is oriented such that a flowing fluid 132 has a flow direction that is aligned with the radial direction 26 (FIG. 1A). However, in some embodiments discussed later, just a component of the flow direction of the flowing fluid 130 is aligned with the radial direction 26, as opposed to the direction of the flowing fluid is aligned with the radial direction or direction transverse or perpendicular to the longitudinal axis of the downhole tool. Also, in some embodiments, the fluid passage 130 may have an orientation that has a slope, represented by an angle $\beta$ that is not ninety degrees offset from the longitudinal axis 24, e.g., sixty degrees, forty-five degrees, thirty degrees, etc, indicated in FIG. 2. The angle $\beta$ is the angle between the longitudinal axis of the downhole tool 24 and the direction of the fluid flow 23. The first flow line 104, the second flow line 106 and the flow section 122 together form one continuously connected flow line as part of the inner bore of the downhole string or downhole tool.

The pulse generator 100 generates pressure variations in a flowing fluid by using the flow control member 124 to selectively form a fluid barrier in the fluid passage 130. The fluid barrier increases a pressure in an upstream section, e.g., in the first flow line 104 (FIG. 1A) and decreases pressure in the downstream section, e.g., in the second flow line 106

(FIG. 1A). The fluid barrier may be a complete blockage of flow, or a blockage of flow sufficient to form an observable change in pressure at a selected location in the flow line; e.g., a surface location. As used herein, the term "blocking flow" or "substantially blocking flow" or "reducing the cross sectional flow area", means that fluid flow has been restricted to a point where a pressure variance can be detected and characterized at a selected location. Additionally, the detection and characterization is of sufficient detail as to convert the pressure pulses into information at the selected location.

The actuator 126 can move the flow control member 124 between a closed position wherein fluid flow is blocked to an open position wherein fluid flow is unimpeded by the flow control member 124. The actuator may use an actuation rod 121, located between the actuator and the flow control member. The flow control member 124 acts as a shear valve and shears the flowing fluid. Shearing a fluid refers to moving the flow control member in a direction transverse to the fluid flow. As will be apparent in the description below, when the flow control member 124 is in the open position, there is minimal, if any, restriction of the flow passage 130. Thus, solids in fluids such as lost circulation material (LCM) can pass through without clogging or otherwise obstructing the pulse generator 100. Additionally, because the flow control member 124 shears the flowing fluid, the pulse generator 100 may be operated at higher speeds than conventional valves that operate against a differential pressure.

FIGS. 1 and 1*a* show the advantages associated with locating an actuator outside the outer wall of the flow line or flow section including a shearing flow control member, also referred to as a valve or shear valve: (i) shearing the flow by the shear valve achieved due to a transverse arrangement of the fluid flow direction and the valve movement, (ii) creating a big cross sectional flow area in the flow line/section when the shear valve is in an valve open position up to opening the flow section completely (full cross section of the flow line unblocked) when the valve is moved out of the flow line partially or completely, (iii) no stator is included in this arrangement which reduces the cross section of the flow line permanently in an valve open and valve closed position. In a conventional shear valve arrangement as used in downhole applications the shear valve rotates or oscillates in the flow section and the actuator is located within an outer limit of the flow line/section, respectively. The actuator may be immersed in the fluid, or may be located inside a housing in the flow line and this way is surrounded by fluid or fluid flow. Further the rotating shear valve has a stator. The rotating shear valve in conjunction with the stator, open and close a plurality of openings having a total cross section which is significantly smaller than the cross section of the flow line/section in which it is located. In a conventional shear valve set-up the maximum cross sectional flow area of the flow section (shear valve in open position) for the flow to pass through usually is smaller than 50% of the total cross section of the flow line. In a conventional shear valve set-up the open cross section is also split up in a plurality of smaller open cross sectional flow areas. The plurality of smaller cross sectional flow areas make it difficult for an LCM material to pass through without clogging the cross sectional flow areas. LCM material are substances added to drilling fluid when drilling fluids are being lost to the formation downhole. Commonly lost circulation materials include fibrous (cedar bark, shredded cane stalks, mineral fiber and hair), flaky (mica flakes, and pieces of plastic or cellophane sheeting) or granular (ground and sized limestone or marble, wood, nut hulls, Formica, corncobs and cotton hulls). FIG. 1 shows how an actuator can be conveniently located outside the outer wall or limit of the flow line/section in order to directly effect translation (linear movement) of flow control member 124, the translating motion being able to both block and unblock the flow section 122 completely. In downhole tools the space for installing a valve and an actuator is limited. Linearly moving a flow control member by an actuator as indicated in FIG. 1 poses design challenges and limitations with respect to the linear translation distance. Therefore it is desirable to arrange the flow line and the actuator inside the downhole tool in a fashion that leaves enough space for an actuator, in particular a linear acting actuator, to operate. An arrangement of the actuator parallel to the longitudinal axis of the downhole tool is beneficial. In order to place the actuator parallel to the downhole axis the flow line has to be relocated from the straight set-up as displayed in FIG. 1 to a s-shape set-up as displayed in FIG. 1A. In FIG. 1A the actuator may be located in housing volumes 127 *a, b* and may be much longer than it would be possible in FIG. 1. In FIG. 1A an actuator driving a linear movement of flow control member 124 can generate larger strokes than the actuator in FIG. 1.

Referring to FIG. 1A, the actuator 126 may be housed within one or both of volumes 127*a, b*, which are radially adjacent and offset to the first flow line 104 and the second flow line 106, respectively. Stated differently, volume 127*a* is side-by-side of the flow line 104 and end-to-end of the flow line 106. Similarly, volume 127*b* is side-by-side of the flow line 106 and end-to-end of the flow line 104. The space created by volume 127*a* or 127*b* is advantageous in that it can house an actuator 126 that is too long in size to be otherwise accommodated. For example, an actuator 126 may be too long to be placed transversely to the longitudinal axis of the downhole tool (FIG. 1) in particular when the actuator 126 is to generate a stroke that is big enough to completely move the closing member 124 out of the flow section in order to create a large cross sectional flow area for the fluid flow to go through.

The actuator 126 may be a mechanical, electro-mechanical, hydraulic, and/or pneumatic based motor that is configured to move the flow control member 124 in one or more modes such as linear movement, curvilinear movement, rotation or oscillation, tilting, or pendulum-type motion. In one non-limiting embodiment, the actuator 126 is configured to move the flow control member 124 perpendicular to the flow of the fluid or the longitudinal axis of the downhole tool or flow line or flow section. In this case, an angle $\alpha$ is 90 degrees (FIG. 1). In another non-limiting embodiment, the actuator 126 is configured to move the flow control member 124 at a non-perpendicular angle to the flow of the fluid or the longitudinal axis of the downhole tool or flow line or flow section. In this case the angle $\alpha$ may be, for example, 89 degrees, or an angle in the range of 89 to 80 degrees, or 80 to 70 degrees, or 70 to 60 degree, or 60 to 45 degree to the longitudinal axis of the downhole tool or flow line or flow section.

In one non-limiting arrangement, a control unit 134 may operate the actuator 126 in order to transmit encoded pressure pulses. The control unit 134 may include a processor, processor control program, and such additional supporting electrical circuitry (not shown) for converting information generated downhole (e.g., drilling direction, formation parameters, pressures, temperatures, drilling dynamics data etc.) into a pattern of controlled movements of the flow control member 124 that will communicate this information to another downhole location and/or uphole via pressure pulses.

Illustrative, but not limiting, arrangements for the pulse generator 100 are discussed below.

Figure 3A:
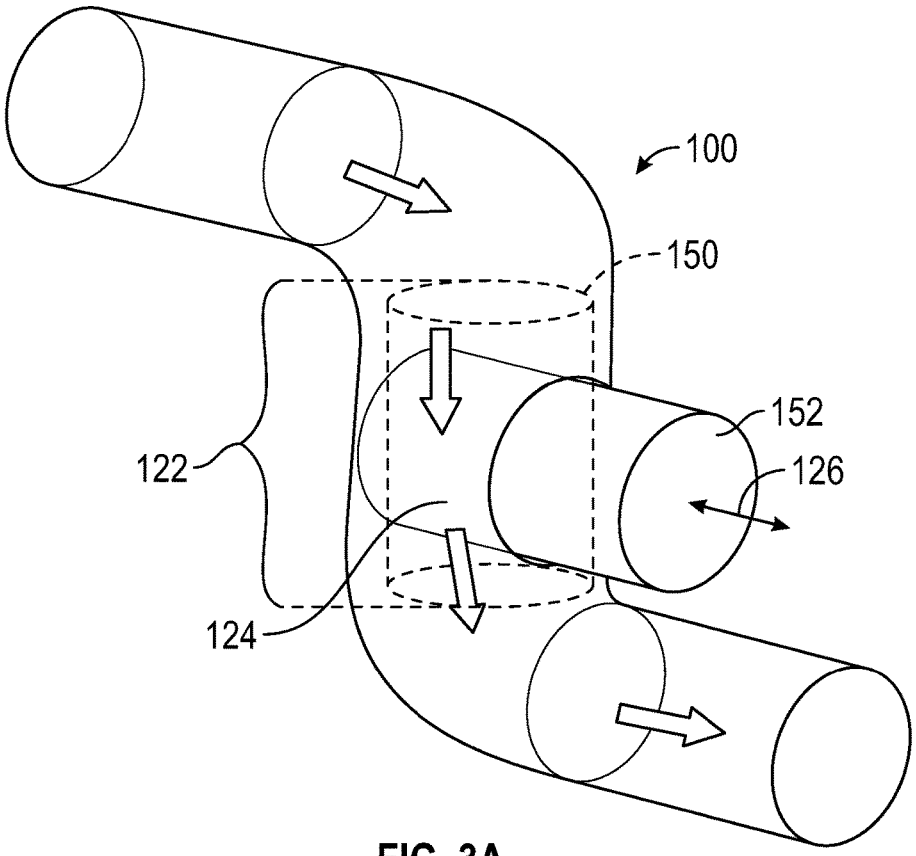
FIGS. 3A-B schematically illustrate a pulse generator in accordance with one embodiment of the present disclosure that uses a translating flow control member.
Figure 3B:
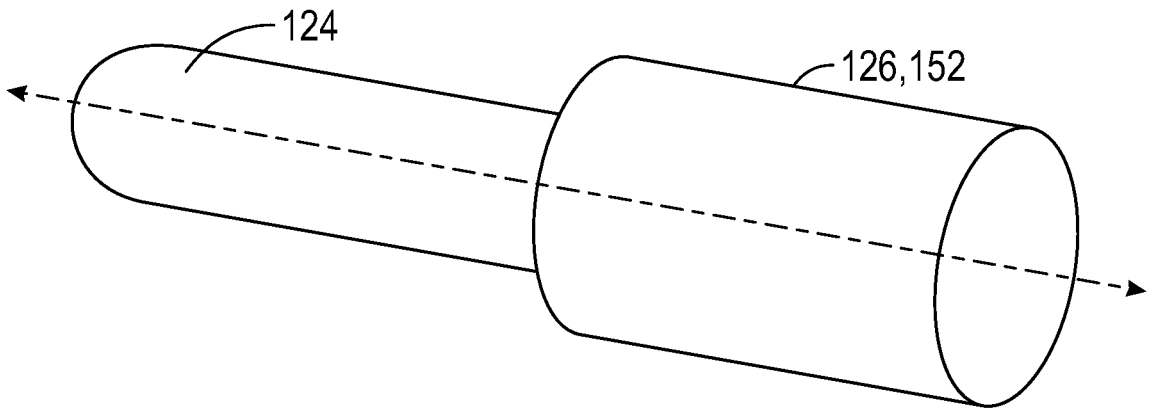

Referring to FIGS. 3A and B, there is shown one non-limiting arrangement of a pulse generator 100 that uses translation, linear, or sliding movement. The pulse generator 100 may include a flow control member 124 that is formed as an elongated body that is shaped and dimensioned to block the flow passage 150 while in the closed position. In the open position, the flow control member 124 may be partially or completely extracted from the flow passage 150. Thus, a maximum amount of flow area is available through which large solids or other particles can easily pass. The flow control member 124 may be moved between the closed position and the open position by an actuator 126 such as a motor 152, which may be a linear-drive electric motor. For example, the flow control member 124 may be attached to a translating rotor (not shown) of the motor 152. However, any of the type of motors/actuators previously described may be used, e.g. a hydraulically driven piston. Also, the flow control member 124 may be of any shape. While a cylindrical body is shown, other suitable shapes and bodies may include tubular, concave, convex, conical, square, rectangular, oval, circular, flat, shaft with flat wing sections perpendicular to the shaft axis etc. Generally, any body shape that presents a surface that can shear a fluid body and can block fluid flow through the flow passage 150 may be used.

Figure 4A:
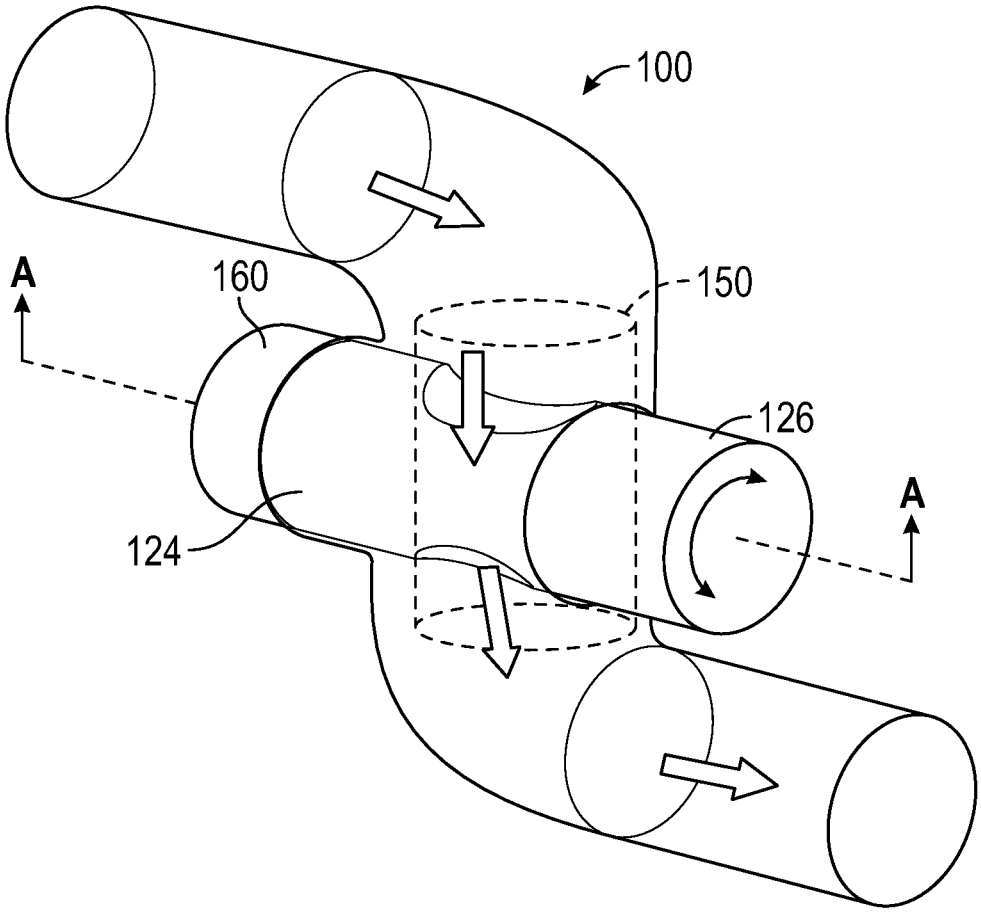
FIGS. 4A-C schematically illustrate a pulse generator in accordance with one embodiment of the present disclosure that uses a rotating flow control member.
Figure 4B:
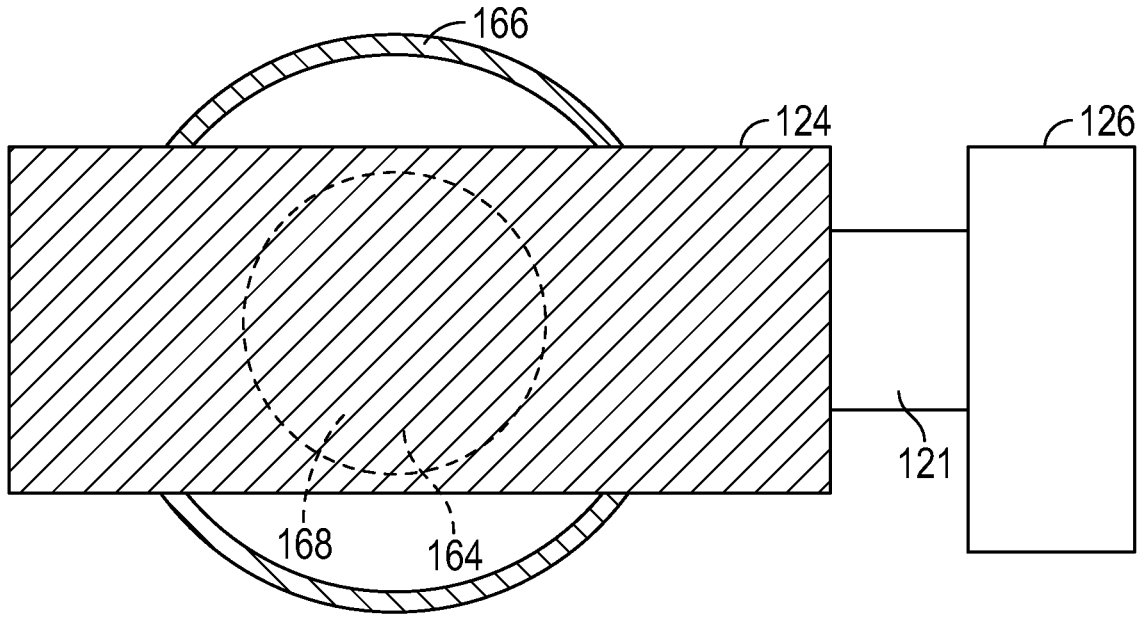
Figure 4C:
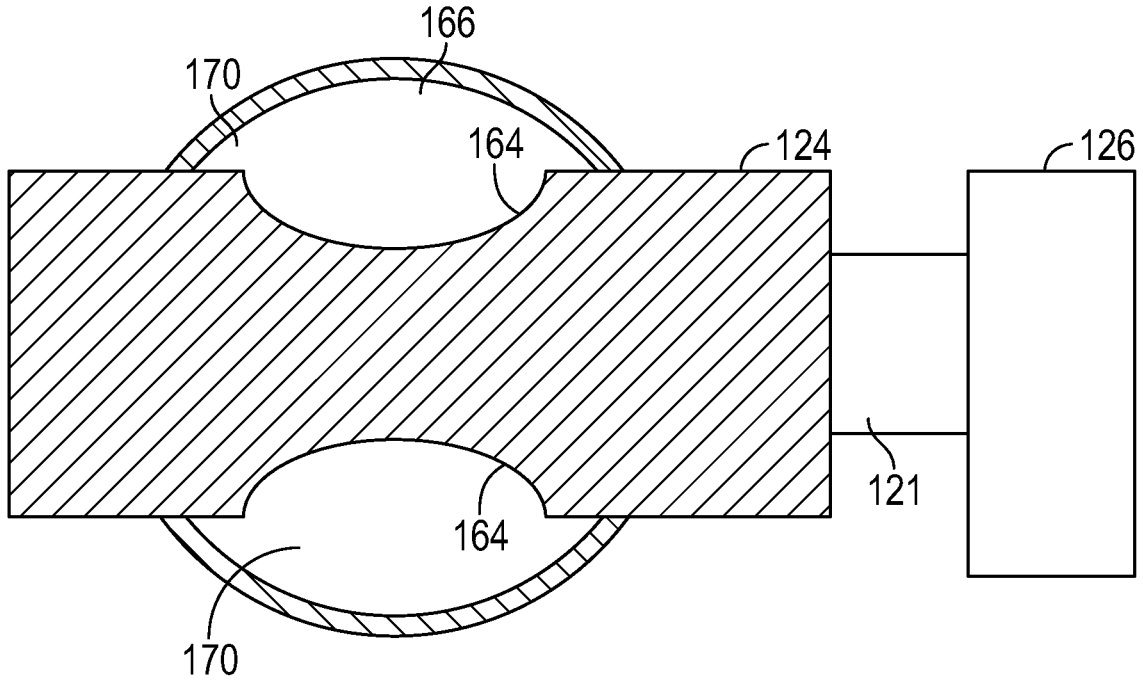

Referring to FIGS. 4A-C, there is shown a non-limiting arrangement of a pulse generator 100 that uses a rotational movement. The rotation may be uni-directional or bi-directional (oscillation). The pulse generator 100 may include a flow control member 124 that is formed as a rotating elongated body that is shaped and dimensioned to fully block the flow passage 150 when in a specified rotational orientation, or the closed position. The flow control member 124 may be supported by a suitable bearing structure 160 at one end and rotated at the opposing end by the actuator 126. Alternative embodiments may include a rotary shaft seal, a retaining ring, a locking ring or a shaft seal to fix the flow control member at the opposing end. Any of the type of motors/actuators previously described may be used as the actuator 126. The flow control member 124 may be shaped to have a first cross-sectional profile that blocks fluid flow through the flow passage 150 by reducing the cross sectional flow area and a second cross-sectional profile that allows fluid flow through the flow passage 150 by increasing the cross sectional flow area.

In one shear valve arrangement shown in FIGS. 4B, C, the elongated body 124 may have one or more notches 164. The notches 164 are defined by one or more recessed surfaces 168 that can reduce the amount of cross-sectional area that is blocked by the flow control member 124. FIG. 4B is a top view of the flow control member 124. Portions of the walls 166 defining the flow passage 150 (FIG. 4A) are shown in a sectional view for clarity. As can be seen, in the orientation of FIG. 4B, the flow control member 124 blocks most of the flow passage 150 in the flow section and reduces the cross sectional flow area and this way creating an pressure increase in the flow line 104. In FIG. 4C, the flow control member 124 has been rotated by a specified amount, e.g., seventy or ninety degrees, to the open position. The recessed surfaces 168 defining the notches 164 and the wall 166 are defining a bigger cross sectional flow area as with the position in FIG. 4B and therefore form a bigger flow paths 170 through which drilling fluid and other fluid having entrained large solids or particles can easily pass and decrease the pressure in flow line 104.

It should be noted that while two notches 164 are shown, other embodiments may use one notch or three or more notches. Also, the notches 164 may be curved, squared, or use any other geometrical shape. Additionally, while two rotational orientations are shown, three or more orientations may be used. The flow paths of these orientations may present the same cross-sectional flow area or different cross-sectional flow areas; e.g., zero flow, fifty percent flow, eighty percent flow, etc.

Figure 5A:
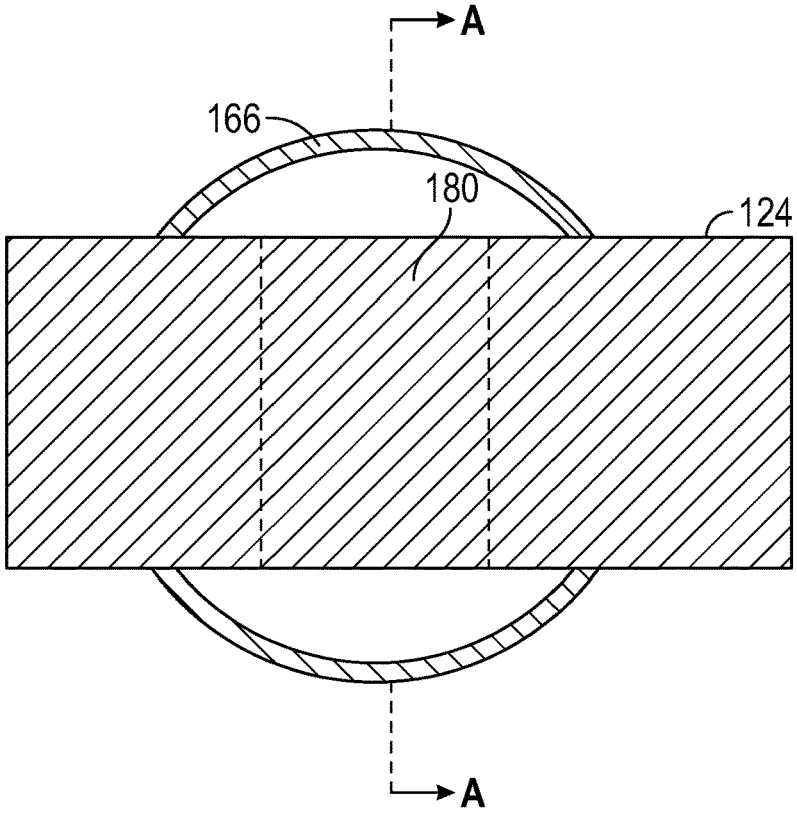
FIGS. 5A-C schematically illustrate another pulse generator in accordance with one embodiment of the present disclosure that uses a rotating flow control member.
Figure 5B:
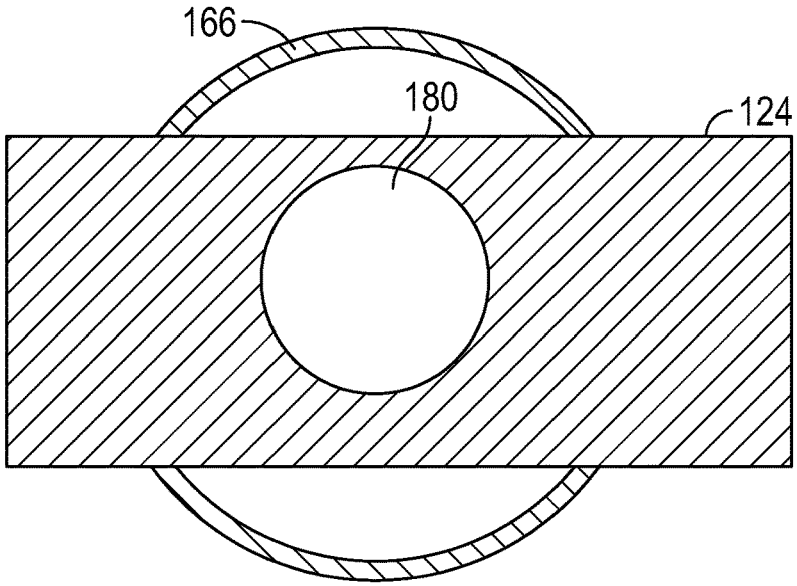
Figure 5C:
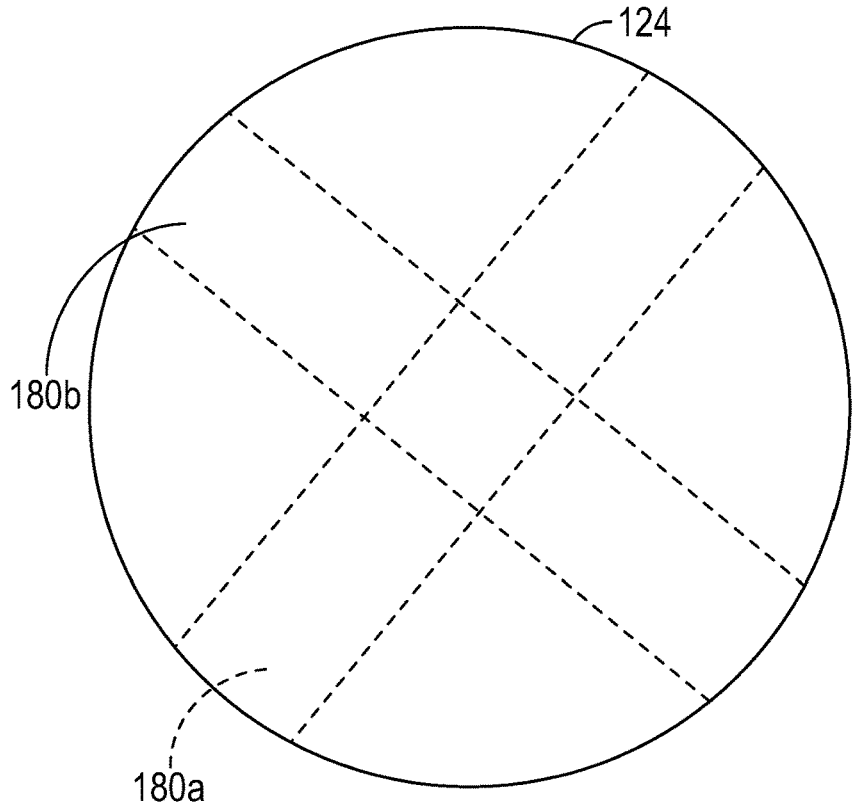

Referring to FIGS. 5A-C, there are shown other flow control members that may be rotated or oscillated to have a first cross-sectional profile that blocks fluid flow through the flow passage 150 (FIG. 5A) and a second cross-sectional profile that allows fluid flow through the flow passage 150 (FIG. 5B). In FIGS. 5A-C, the flow control member 124 include one or more bores or holes 180 that pass completely through the flow control member 124. FIG. 5A is a top view of the flow control member 124. As can be seen, in the orientation of FIG. 5A, the flow control member 124 blocks most of the flow passage 150 in the flow section and reduces the cross sectional flow area and this way creating an pressure increase in the flow line 104. In FIG. 5B, the flow control member 124 has been rotated by ninety degrees. The hole 180 forms a large additional flow path through the flow control member 124 through which fluids and particles with large entrained materials can pass and decrease the pressure in flow line 104. FIG. 5C illustrate that the flow control member 124 may have two or more holes 180*a,b* that allow fluid flow at different angular positions of the flow control member 124. The holes 180 may be axially-spaced apart from one another. This may be used, for example, to have two or more different amounts of flow area for the flow passage 150 (FIG. 4A). Also, while one hole 180 is shown in FIGS. 5A and B, two or more holes may also be used.

Figure 6:
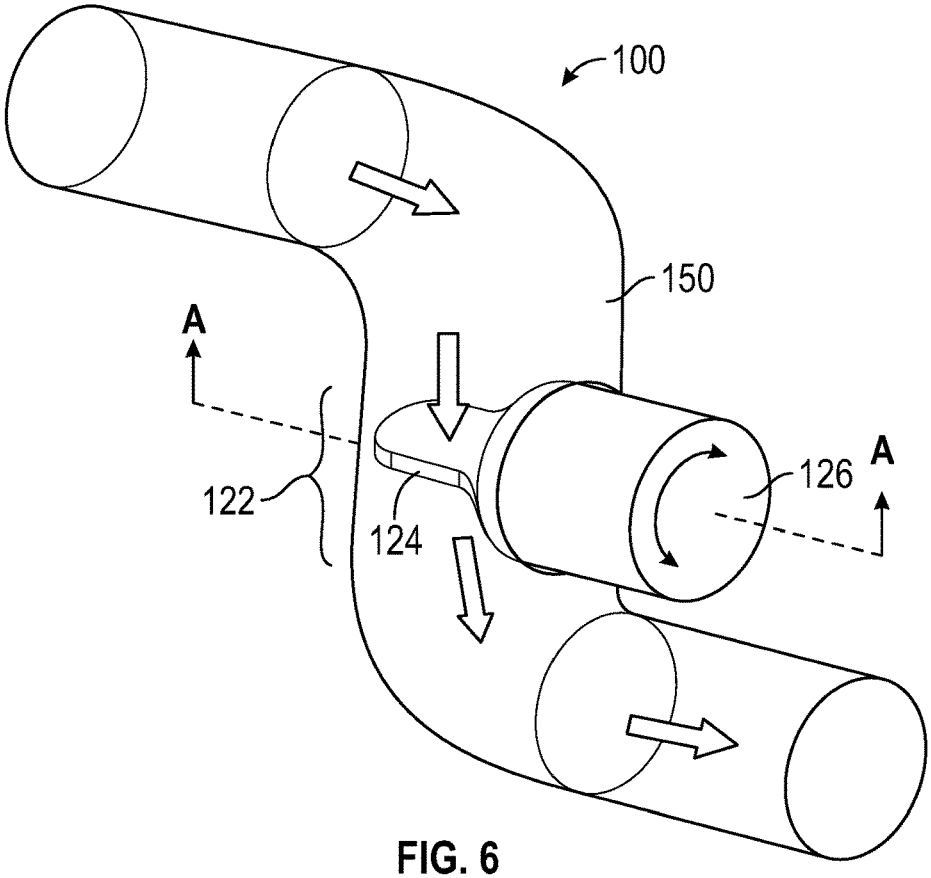
FIG. 6 schematically illustrate a pulse generator in accordance with one embodiment of the present disclosure that uses a plate-like flow control member.
Figure 6A:
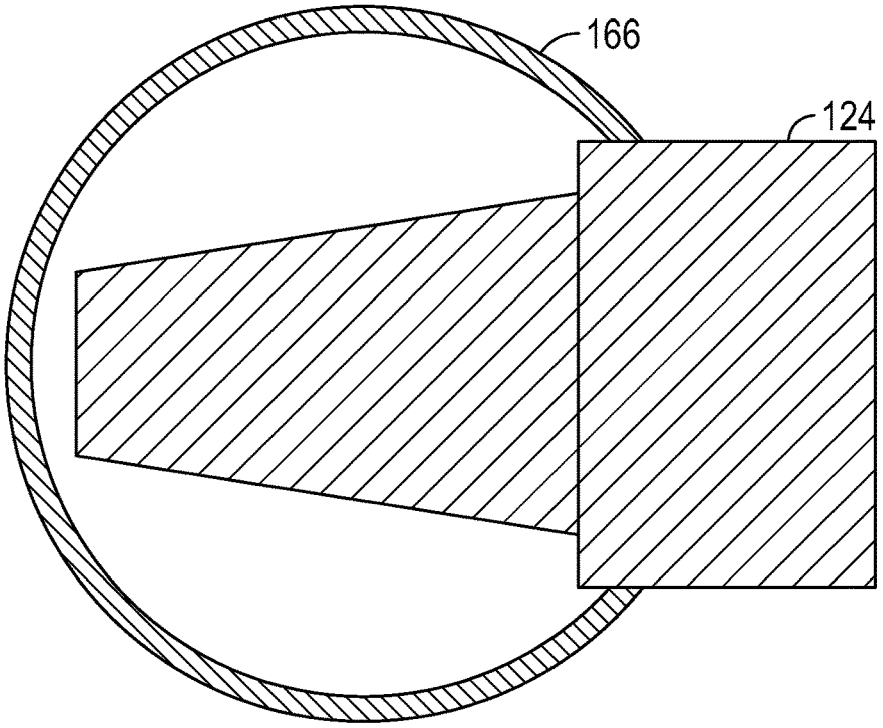
FIGS. 6A and 6B shows the FIG. 6 configuration in a closed and open configuration respectively.
Figure 6B:
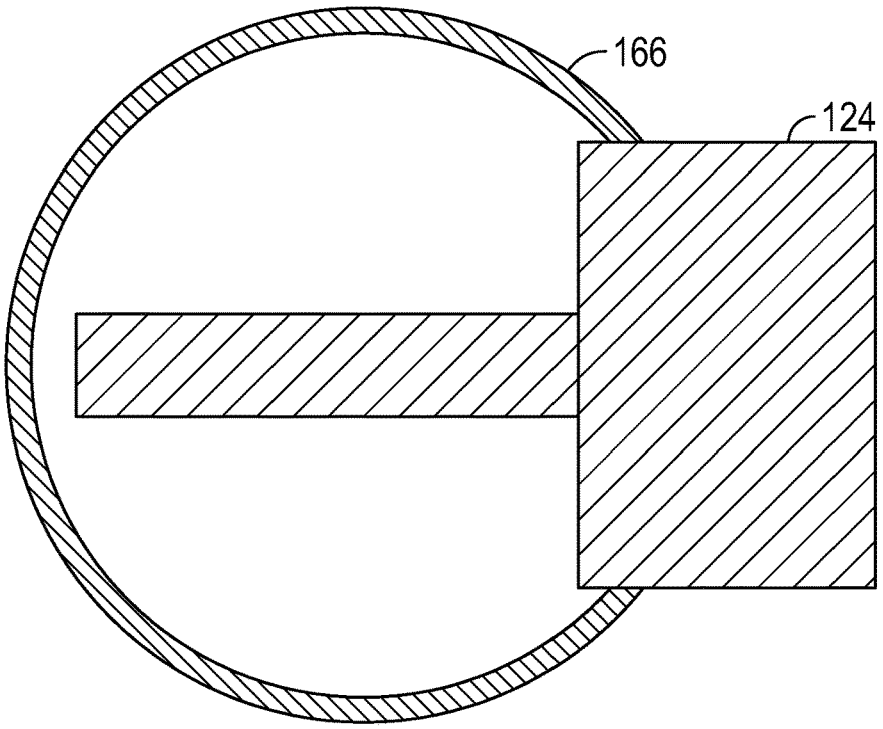

Referring to FIG. 6, there is shown another non-limiting arrangement of a pulse generator 100 that uses a rotational movement. The rotation may be uni-directional or bi-directional (oscillation). The pulse generator 100 may include a rotating flow control member 124 that is formed as a flat plate that is shaped and dimensioned to block the flow passage 150 when in a specified rotational orientation. The flow control member 124 may be cantilevered in the flow passage 150 and only supported by the actuator 126. Any of the type of motors/actuators previously described may be used as the actuator 126. The flow control member 124 may be sized and shaped to fit in the flow passage 150, to block a desired portion of the fluid flow and to have a thickness that causes minimal blockage of fluid flow in the flow passage 150 when in the open position. Thus, by rotating the flow control member 124 ninety degrees or other angular amount, the pulse generator 100 can move between minimal obstruction of flow and maximum blockage of flow as illustrated in FIGS. 6A and 6B.

The flow section 122 and flow lines 104, 106 may also have various different embodiments as illustrated in FIGS. 7A-C and 8A-C.

Figure 7A:
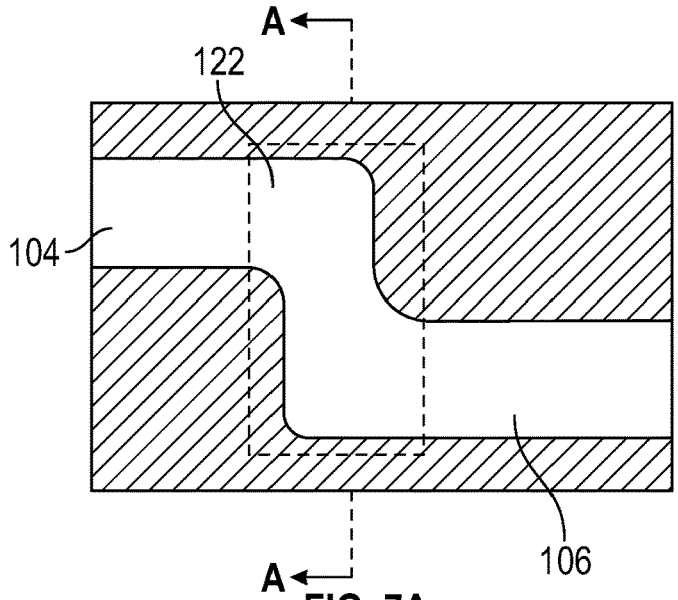
FIGS. 7A-C sectionally illustrate embodiments of flow sections in accordance with the present disclosure.
Figure 7B:
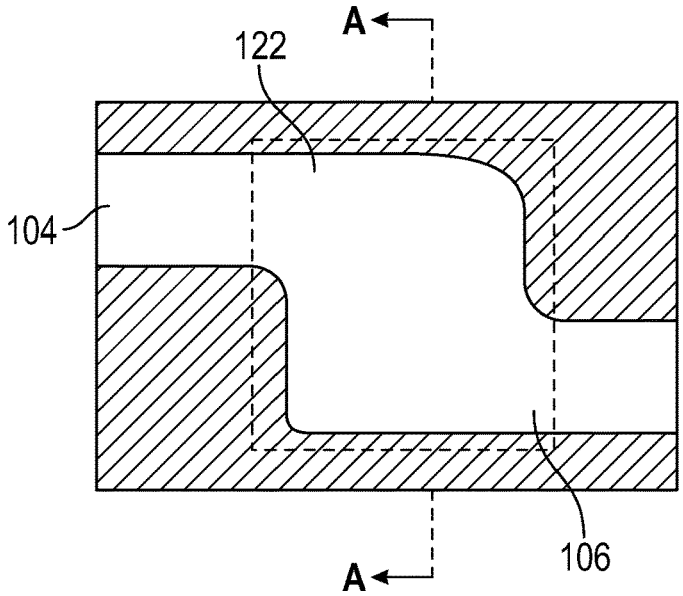

FIGS. 7A and B are side sectional views that show flow lines 104 and 106 connected by the flow section 122. The flow sections of FIGS. 7A and B include relatively sharp turns of direction, e.g., a ninety-degree elbow. FIG. 7A shows the flow lines 104 and 106 completely radially offset from one another. This complete radial offset forces all the fluid flowing from flow line 104 to move at least partially in a radial direction in order to enter the flow line 106. FIG. 7B shows the flow lines 104 and 106 with a small radial offset and an elongated flow section 122 in a direction parallel to the longitudinal axis of the downhole tool. This arrangement lead to a noncircular flow section (top view), but rather elliptical flow section. The elongated shape of the flow section allows for an elongated shape of the flow control member in the direction parallel to the longitudinal axis of the downhole tool. The elongated shape of the flow control member leads to a shape with a narrow extension in radial direction (transverse to the longitudinal axis of the downhole tool, which in turn reduces the angular momentum to free the flow control member needed to be provided by the actuator in case the flow control member may be blocked by LCM. The narrower shape of the flow control member leads to s shorter leaver created by the shape of the flow control member compared with a wide shape of the flow control member which is shaped to reside in a circular flow section. It is to be understood that the radial offset of the flow line 104 and flow line 106 may be reduces up to a point where the flow lines overlap (side view parallel the longitudinal axis of the downhole tool). This partial radial overlap can allow some of the fluid flowing from flow line 104 to enter the flow line 106 without moving in a radial direction.

Figure 7C:
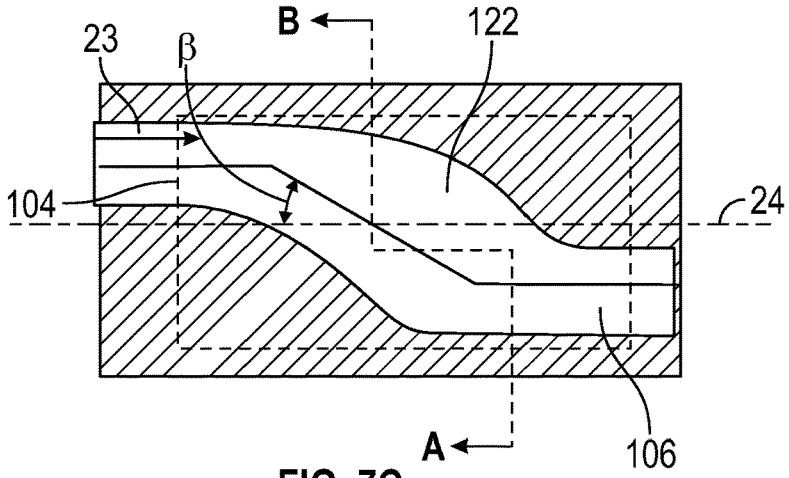
Figure 8A:
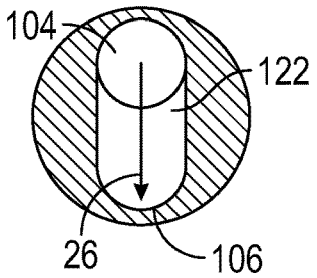
FIGS. 8A-D sectionally in end views illustrate embodiments of flow sections in accordance with the present disclosure.
Figure 8B:
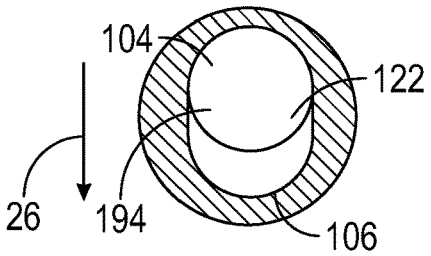
Figure 8C:
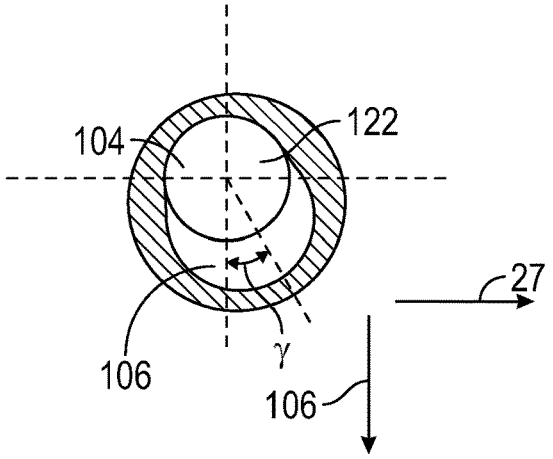

FIG. 7C is a side sectional view that illustrates an arrangement where the flow lines 104 and 106 are radially offset and angularly offset (angle γ, see FIG. 8C). The radial offset may cause either no overlap or a partial overlap as discussed in connection with FIGS. 7A and B. Nevertheless, the radial offset causes some or all the fluid in the flow section 122 to move in a first radial direction 26. Additionally, the angular offset forces the fluid to also move in a second different radial direction 27 in order to enter the flow line 106. Another distinction is that the FIG. 7C flow section 122 does not use sharp angles such as ninety degree elbows to re-direct flow. Instead, the FIG. 7C flow section 122 uses a gradual curve. The avoidance of sharp angles reduces the likelihood of washouts in the flow line due to fast flowing fluid with solid particles included in the fluid. The embodiments depicted in FIGS. 7A and 7B with no angularly offset may also form smooth transitions (sloped transition) from flow line 104 to flow line 106, indicated by slope angle β (FIG. 7C).

Figure 7D:
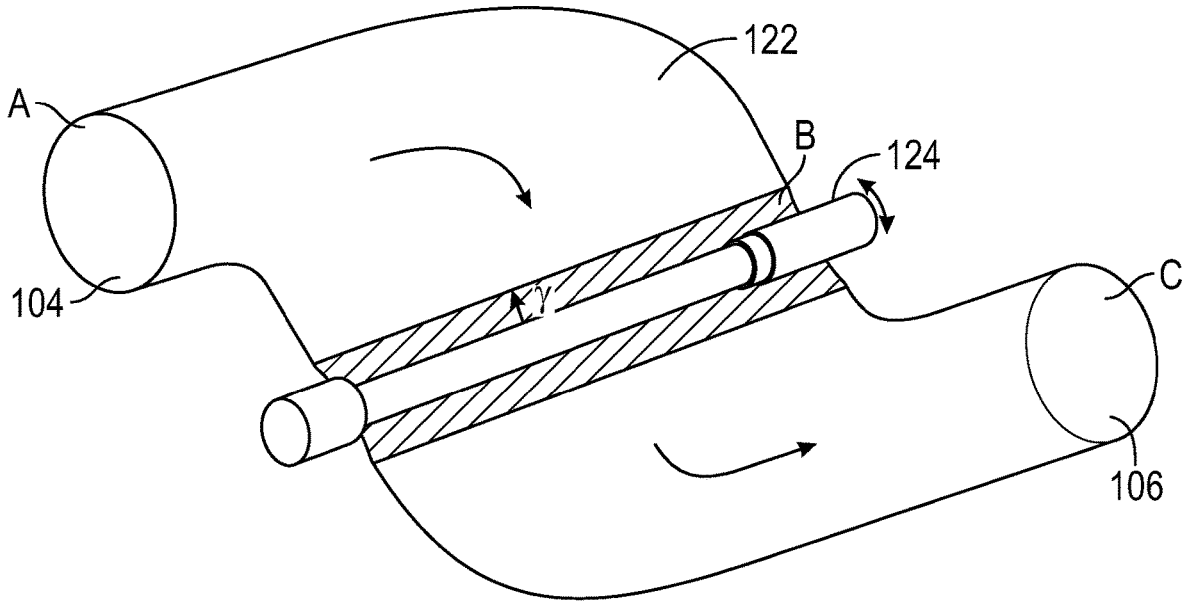
FIG. 7D illustrates a non-limiting configuration of a flow section in accordance with the present disclosure.

FIG. 7D illustrates another non-limiting arrangement where the respective areas A and C of the cross sections on the flow line 104 and flow line 106 and the area B of the cross section of the actual flow section 122 are identical or more or less the same but have different shape. The area B of the cross section of the flow section 122 is achieved by elongation of the cross section in the direction parallel to the longitudinal axis of the downhole tool and contraction perpendicular to the longitudinal axis of the downhole tool. In this arrangement, the flow control member 124 that is formed as a rotating elongated body, can be shaped and dimensioned to substantially fully block the flow of fluid in the flow section when in a specified rotational orientation. In this case, the elongated cross-sectional profile of the flow control member 124 in the direction of the longitudinal direction of the downhole tool allows the flow control member to be short in radial direction by keeping the flow area of the flow line 104 and/or 106. The lever r (FIG. 7D) with respect to the rotational axis of the flow control device in the radial gap is smaller than the lever in flow control members represented in embodiments with a circular cross section of the flow section. The smaller lever is beneficial in case the flow control member may be blocked by LCM. The angular momentum needed to unblock the flow control member depends on the lever r and is small when the lever r is small. A constant area of cross section throughout the system maintains the same flow resistance in the flow line and flow section. The embodiment in FIG. 7D may have a flow section in which the cross section B of the flow section 122 is significantly larger as the cross section A and B in flow line 104 and flow line 106.

Figure 8D:
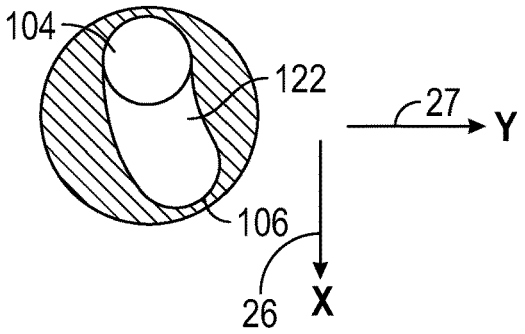

FIGS. 8A-D illustrate variants of relative radial offsets for the flow lines 104, 106. FIG. 8A illustrates an arrangement wherein the radial offset of the flow lines 104, 106 is sufficient to force all of the fluid to flow in radial direction 26 in flow section 122 for a fixed distance. FIG. 8B illustrates an arrangement the radial offset of the flow lines 104, 106 is selected to cause a partial overlap 194 that may allow some fluid to not flow in a radial direction 26 ($x$) in the flow section 122. FIG. 8C illustrates an arrangement wherein the radial offset causes some or all of the fluid in the flow section 122 to move in a first radial direction 26 and the angular offset forces the fluid to also move in a second different radial direction 27 ($y$). FIG. 8D illustrates an arrangement wherein the flow section 122 first flows in a radial direction 26 and then flows at least partially in the second different radial direction 27.

Figure 9:
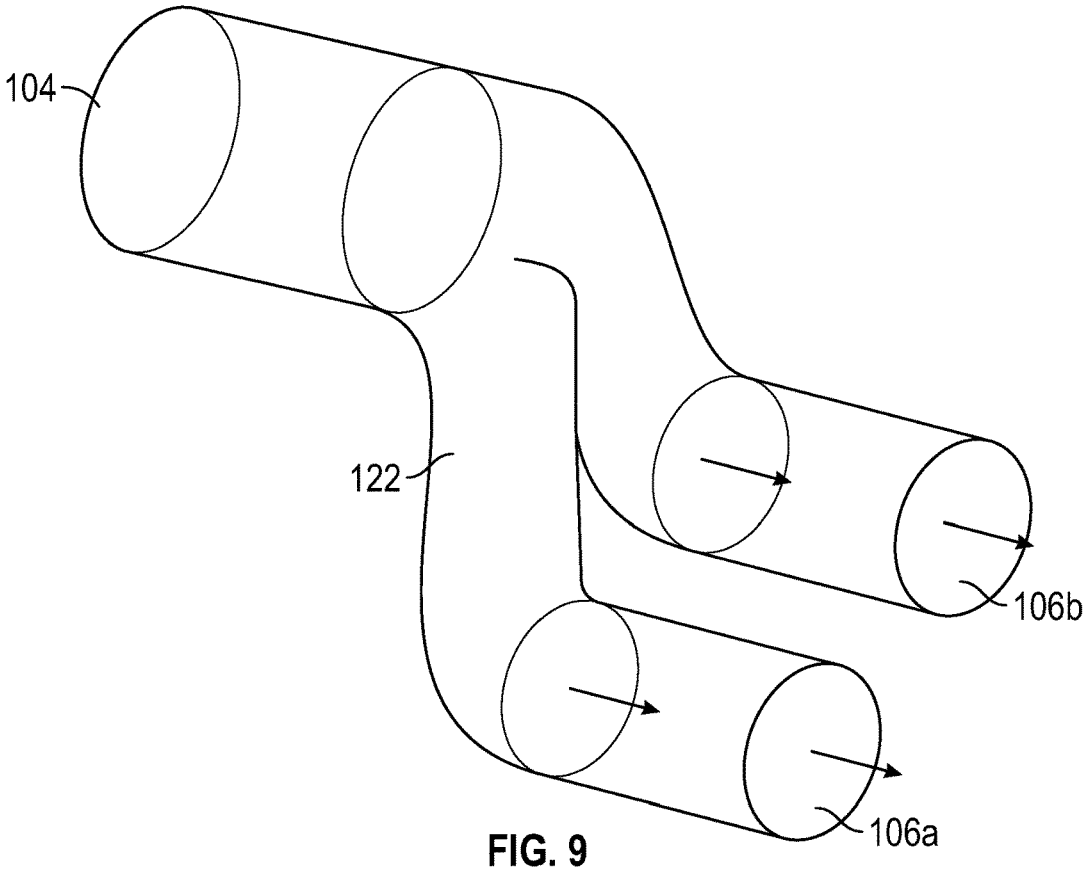
FIG. 9 isometrically illustrates a pulse generator in accordance with one embodiment of the present disclosure that uses two exit flow lines.

FIG. 9 is an isometric view of an embodiment in which the fluid exiting the flow line 104 apparatus feeds two flow lines 106*a,b* using different paths. The flow line 106*a* apparatus receives fluid from the flow section 122. The flow line 106*a* may convey this fluid toward the drill bit (not shown) or other downhole location. The flow line 106*b* receives fluid directly from the flow line 104. That is, the flow section 122 including the flow control member 124 is completely bypassed. This fluid may be communicated to another location, which may be an actuator or other downhole tool. The flow may be divided evenly or unevenly. For instance, more than fifty percent may flow via 106*a* and less than fifty percent may flow via line 106*b*. It should be understood that three or more flow lines for the exiting fluid may also be used.

Figure 10A:
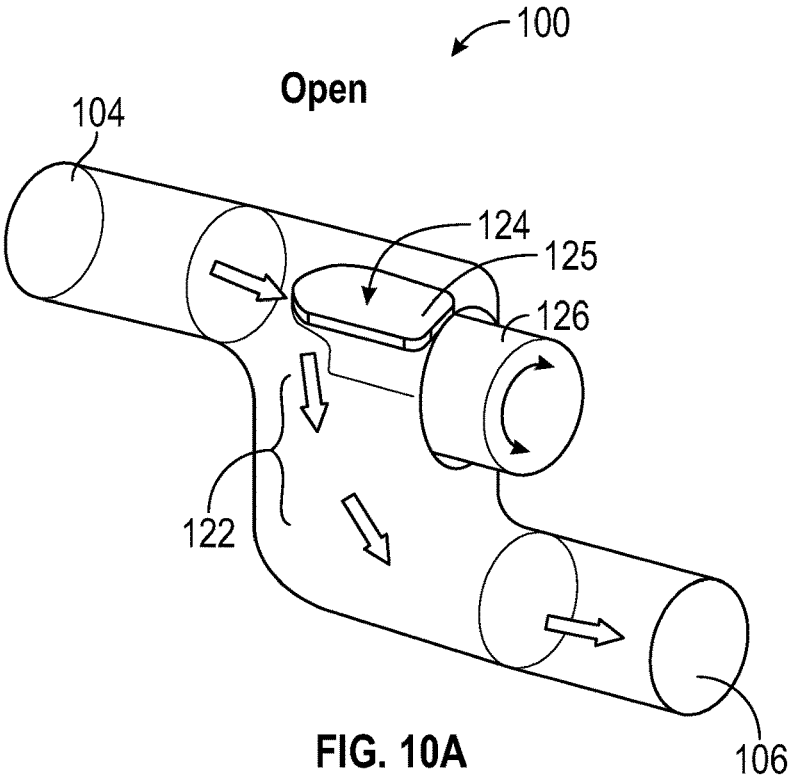
FIGS. 10A-B isometrically illustrate a pulse generator in accordance with one embodiment of the present disclosure that positions the flow control member in one of the flow lines.
Figure 10B:
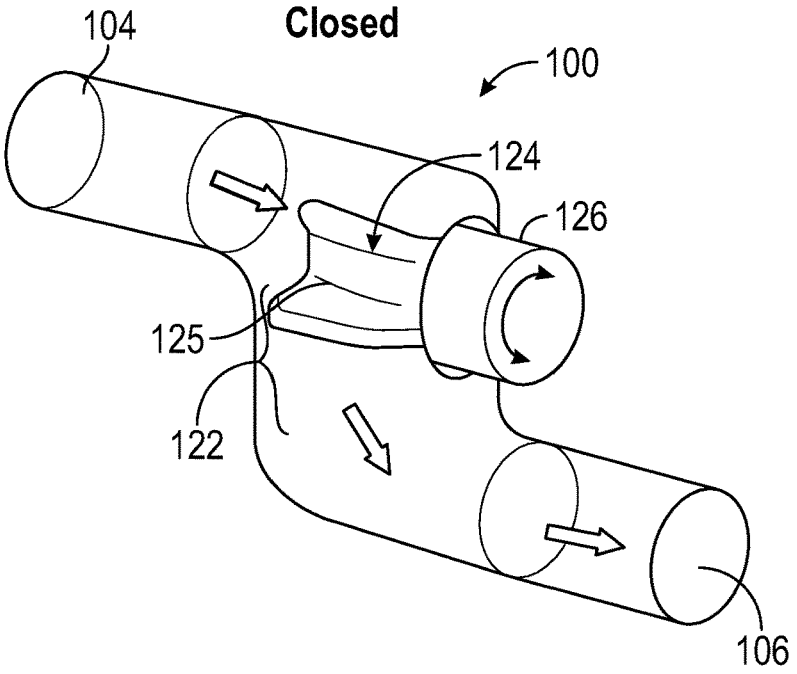

Referring to FIGS. 10A, B, there is shown a non-limiting arrangement of a pulse generator 100 that uses a rotation movement wherein a flow control member 124 is positioned at least partially in or immediately axially adjacent to the flow line 104 while the pulse generator 100 is in the open position. In a variant, the flow control member 124 may also be immediately adjacent to the flow line 106. The rotation may be uni-directional or bi-directional (oscillation). In the shown open position of FIG. 10A, a flow blocking surface 125 of the flow control member 124 does not protrude into the flow path of the fluid flowing between the flow line 104 and the flow section 122. The flow blocking surface 125 may be a plate, disk, or paddle like member that shears the fluid during rotation and has a shape that can seal the flow section 122. The shape may be circular, oval, or any other suitable geometric shape. The flow control member 124 may be rotated by an actuator 126. Any of the type of motors/actuators previously described may be used as the actuator 126. In FIG. 10B, the flow control member 124 is shown in the closed position wherein the flow blocking surface 125 has been rotated into and blocks flow through the flow section 122. Thus, in this embodiment, the flow control member 124 remains inside the sections of the drill string where fluid is flowing.

Figure 11:
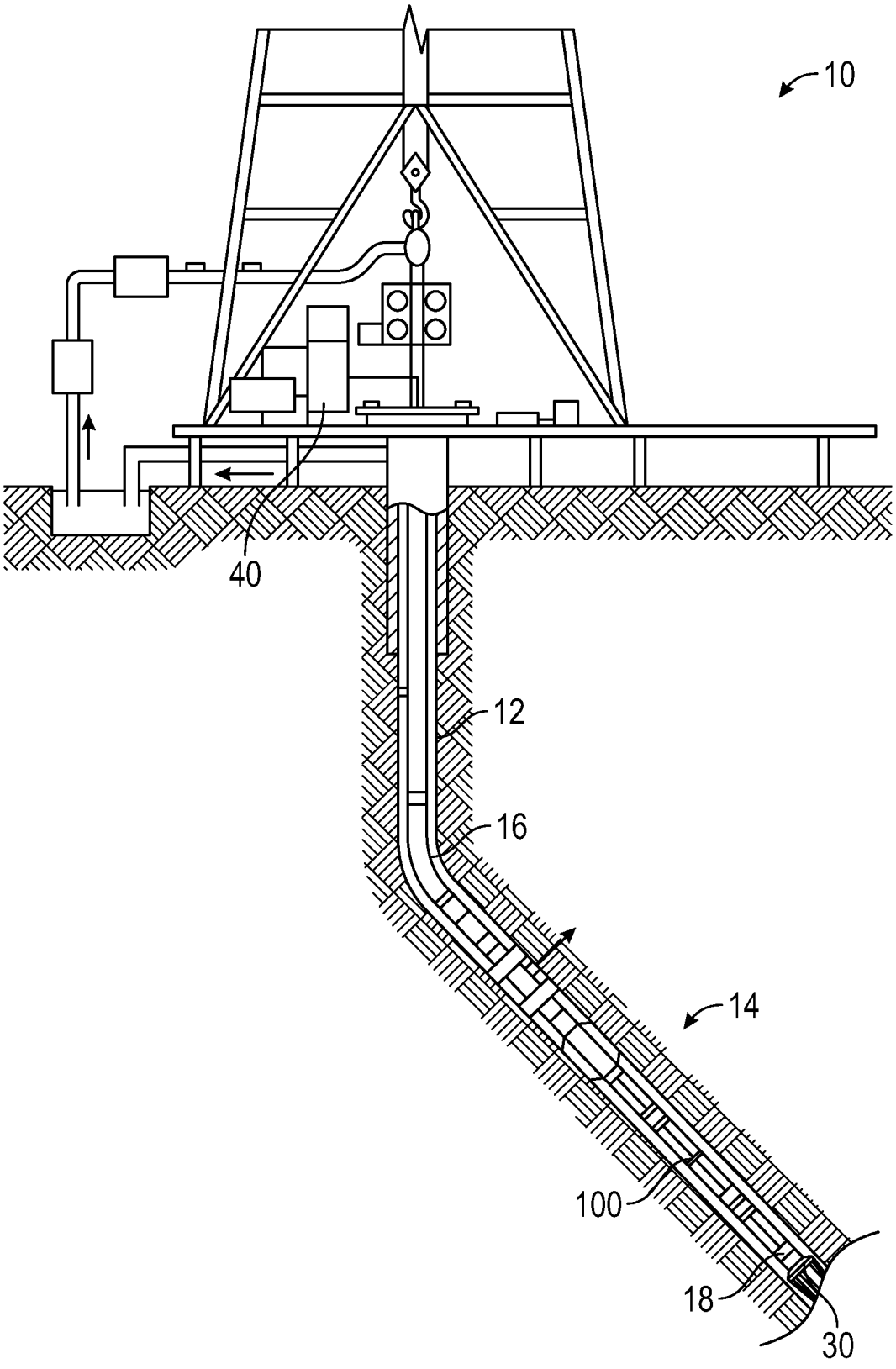
FIG. 11 schematically illustrate a drilling system that may use a pulse generator in accordance with one embodiment of the present disclosure.

Referring now to FIG. 11 there is schematically illustrated a drilling system 10 that may include a pulse generator 100 according to aspects of the present disclosure. A pulse generator 100 may be used to generate pressure pulses in a fluid circulating in a borehole 12. While a land system is shown, the teachings of the present disclosure may also be utilized in offshore or subsea applications. A drilling system 10 may have a bottom hole assembly (BHA) or drilling assembly 14 is conveyed via a string 16 (or 'drill string')

into the borehole 12. The tubing 16 may include a rigid carrier, such as jointed drill pipe or coiled tubing, and may include embedded conductors for power and/or data for providing signal and/or power communication between the surface and downhole equipment. The BHA 14 may include a drilling motor 18 for rotating a drill bit 30. The BHA 14 includes hardware and software to provide downhole "intelligence" that processes measured and preprogrammed data and writes the results to an on-board memory and/or transmits the results to the surface. For transmission to the surface in mud pulse telemetry, data is typically encoded pursuant to a selected communication protocol. Any of a wide variety of communication protocols for communicating data through a pulse series in a downhole fluid (mud) can be implemented, including frequency-shift keying (FSK), phase-shift keying (PSK), amplitude-shift keying (ASK), and combinations of the above, as well as other communication protocols. Processors disposed in BHA 14 may be operatively coupled to one or more downhole sensors that supply measurements for selected parameters of interest including BHA 14 or drill string 16 orientation, formation parameters, and borehole parameters. The processor may also control the actuator in the pulse generator 100. In one arrangement, the drilling system 10 may include a pulse detector 40 at a surface location. The pulse detector 40 may include a fluid and pressure sensor (not shown) in fluid communication with the fluid are being circulated into the borehole 12 and/or flowing out of the borehole 12. The pulse of detector 40 may also include a suitable processor and related electronics for decoding the sensed pressure pulses.

In one non-limiting mode of operation, that BHA 14 operates to drill the borehole 12. During this time, the drilling fluid, such as drilling mud, is circulated through the drill string 16. The pulse generator 100 may transmit communication uplinks as needed to convey information to the surface or another downhole location. In some situations, the BHA 14 may penetrate into a weak formation. Such a formation can draw drilling fluid out of the borehole 12, thereby causing an undesirable loss of drilling fluid. To remedy such a situation, a "lost circulation material" may be circulated into the borehole 12 via the drill string 16. The loss situation material may include solids of much larger size than the solids present in conventional drilling fluid. The lost circulation material penetrates into the weak formation and forms a seal along a borehole wall at the weak formation. The lost circulation material being circulated in the borehole 12 can pass through the pulse generator 100 because the flow passages in the open position easily allow entrained particles to pass through. Thus, the pulse generator 100 can continue to operate and send information to the surface without being clogged by the solids in the lost circulation material. It is to be emphasized that all embodiments of the pulse generator disclosed here have not included a stator and all embodiments are using shear valve configurations of the flow control member.

The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein.

What is claimed is:

1. An apparatus for generating pressure variances in a fluid flowing in a downhole tool having a longitudinal axis, comprising:

a flow section directing the fluid flow, the flow section having an outer wall, a flow control member positioned inside the flow section and configured to selectively block the fluid flow in the flow section;

an actuator configured to move the flow control member between a first position wherein the flow control member at least partially blocks the fluid flow in the flow section and a second position wherein the flow control member reduces the at least partial blockage of the fluid flow in the flow section, wherein the actuator is disposed outside the outer wall of the flow section; and a first flow line directing the fluid flow into the flow section and a second flow line receiving the fluid flow from the flow section, wherein the first flow line and the second flow line direct the fluid flow in a direction aligned with the longitudinal axis, wherein the first flow line is at least partially radially offset from the second flow line, and wherein the flow section is configured to direct the fluid flow from the first flow line in a direction that is transverse to the longitudinal axis of the downhole tool to the second flow line.

2. The apparatus of claim 1, wherein the actuator is configured to move the flow control member using a mode selected from at least one of: (i) translation, (ii) rotation, (iii) oscillation, and (iv) rocking.

3. The apparatus of claim 1, wherein a housing volume is formed radially offset to at least one of: (i) the first flow line, and (ii) the second flow line, and wherein the actuator is disposed in the housing volume.

4. The apparatus of claim 1, wherein the flow control member is one of: (i) a translating member, (ii) a rotating member, and (iii) an oscillating member.

5. The apparatus of claim 1, wherein the movement of the flow control member is in a direction that is at least partially transverse to the fluid flow.

6. The apparatus of claim 1, wherein, in the second position, the flow control member has a flow blocking surface that is positioned at a location selected from one of: (i) at least partially in the first flow line, and (ii) immediately axially adjacent to the first flow line.

7. The apparatus of claim 1, further comprising:

a drill string section in which the flow section, the flow control member, and the actuator are positioned, the drill string section being the downhole tool;

and a control unit configured to control the actuator to impart the pressure variances into the fluid flow in the flow section, wherein the actuator and the control unit are positioned in at least one housing volume radially offset to at least one of: (i) the first flow line, and (ii) the second flow line.

8. The apparatus of claim 7, further comprising a pressure sensor at a surface location for detecting the pressure variances in the fluid flow.

9. The apparatus of claim 1, wherein a cross section of the flow section is having an elongation in a direction parallel to the longitudinal axis that is greater than an elongation in a direction perpendicular to the longitudinal axis.

10. The apparatus of claim 9, wherein the flow control member is a rotating member and an elongation of the rotating member in the direction parallel to the longitudinal axis is greater than an elongation of the rotating member in the direction perpendicular to the longitudinal axis.

11. The apparatus of claim 10, wherein a flow area of the first flow line and a flow area of the flow section are substantially the same.

12. The apparatus of claim 11, wherein a flow area of the second flow line and the flow area of the flow section are substantially the same.

13. The apparatus of claim 12, wherein the flow area of the first flow line and the flow area of the second flow line are substantially the same.

14. the apparatus of claim 1, further including a third flow line, wherein the first flow line directs the fluid flow in the third flow line, and wherein the third flow line bypasses the flow section and the flow control member.

15. A method for generating pressure variances in a fluid flowing in a downhole tool having a longitudinal axis, comprising:

directing the fluid flow in a flow section having an outer wall;

selectively blocking the fluid flow in the flow section using a flow control member positioned inside the flow section, wherein the flow section directs the fluid flow in a direction that is transverse to a longitudinal axis of the downhole tool; and moving the flow control member between a closed position and an open position using an actuator, wherein the flow control member at least partially blocks the fluid flow in the flow section in the closed position, wherein the flow control member reduces the at least partial blockage of the fluid flow in the flow section in the open position, and wherein the actuator is disposed outside the outer wall of the flow section.

16. The method of claim 15, further comprising directing the fluid flow into the flow section using a first flow line and receiving the fluid flow from the flow section using a second flow line, wherein the first flow line and the second flow line direct flow in a direction aligned with the longitudinal axis.

17. The method of claim 16, wherein the first flow line is at least partially radially offset from the second flow line.

18. The method of claim 16, wherein a housing volume is formed radially offset to at least one of: (i) the first flow line, and (ii) the second flow line, and wherein the actuator is disposed in the housing volume.

19. The method of claim 15, wherein the actuator moves the flow control member using a mode selected from at least one of: (i) translation, (ii) rotation, (iii) oscillation, and (iv) rocking.

20. The method of claim 15, wherein the fluid is drilling mud, and the method further comprises performing mud pulse telemetry using the pressure variances.

* * * * *